US011718978B2

(12) United States Patent
Shimano et al.

(10) Patent No.: US 11,718,978 B2
(45) Date of Patent: Aug. 8, 2023

(54) WORK MACHINE SYSTEM AND CONTROL METHOD

(71) Applicant: KOMATSU LTD., Tokyo (JP)

(72) Inventors: Yuki Shimano, Tokyo (JP); Tomohiro Nakagawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 668 days.

(21) Appl. No.: 16/615,987

(22) PCT Filed: Jul. 4, 2018

(86) PCT No.: PCT/JP2018/025317

§ 371 (c)(1),
(2) Date: Nov. 22, 2019

(87) PCT Pub. No.: WO2019/013061

PCT Pub. Date: Jan. 17, 2019

(65) Prior Publication Data

US 2020/0080287 A1 Mar. 12, 2020

(30) Foreign Application Priority Data

Jul. 14, 2017 (JP) ..... 2017-138353

(51) Int. Cl.
*E02F 9/26* (2006.01)
*E02F 3/32* (2006.01)
*E02F 3/38* (2006.01)

(52) U.S. Cl.
CPC ..... *E02F 9/264* (2013.01); *E02F 3/32* (2013.01); *E02F 3/38* (2013.01)

(58) Field of Classification Search
CPC ..... E02F 9/264; E02F 3/32; E02F 3/38
See application file for complete search history.

(56) References Cited

U.S. PATENT DOCUMENTS 4,491,927 A * 1/1985 Bachmann ..... E02F 9/26 37/348
5,848,485 A * 12/1998 Anderson ..... E02F 3/435 701/50
6,336,077 B1 * 1/2002 Boucher ..... E02F 3/435 702/33
7,181,370 B2 * 2/2007 Furem ..... E02F 9/205 701/50
2001/0056488 A1 12/2001 Maeda et al.
2006/0230645 A1 * 10/2006 McCain ..... E02F 3/437 37/348

(Continued)

FOREIGN PATENT DOCUMENTS

AU 2016336318 A1 * 3/2018 ..... B60R 1/00
CN 106104197 A 11/2016

(Continued)

*Primary Examiner* — Redhwan K Mawari
(74) *Attorney, Agent, or Firm* — Faegre Drinker Biddle & Reath LLP

(57) ABSTRACT

A system includes a work machine having a work implement including a bucket, and a server capable of communicating with the work machine. The work machine transmits an identification number associated with the work machine to the server. The server obtains basic data based on the identification information and used for calculating the position of teeth of the bucket. The server transmits the obtained basic data to the work machine.

10 Claims, 14 Drawing Sheets

(56) References Cited

U.S. PATENT DOCUMENTS

| | | | | |
|---|---|---|---|---|
| 2008/0319710 | A1* | 12/2008 | Hsu | G01G 19/083 702/174 |
| 2013/0033963 | A1* | 2/2013 | Lindskov | G01S 7/52004 367/99 |
| 2013/0158789 | A1 | 6/2013 | Seki | |
| 2015/0301518 | A1* | 10/2015 | Takemoto | G07C 5/02 701/29.1 |
| 2015/0330060 | A1* | 11/2015 | Seki | G01S 19/14 701/33.1 |
| 2016/0010312 | A1* | 1/2016 | Kurihara | E02F 9/2012 701/36 |
| 2017/0002547 | A1 | 1/2017 | Omote | |
| 2017/0114526 | A1* | 4/2017 | Yasuda | E02F 9/264 |
| 2018/0002888 | A1* | 1/2018 | Doyle | E02F 3/961 |
| 2018/0040174 | A1* | 2/2018 | Koshi | E02F 9/26 |
| 2018/0216318 | A1* | 8/2018 | Shike | E02F 9/2054 |
| 2020/0080287 | A1* | 3/2020 | Shimano | E02F 3/435 |

FOREIGN PATENT DOCUMENTS

| | | | | |
|---|---|---|---|---|
| CN | 106888569 | A | | 6/2017 |
| JP | H07-102597 | A | | 4/1995 |
| JP | H09-256416 | A | | 9/1997 |
| JP | 2001-132021 | A | | 5/2001 |
| JP | 2001-312524 | A | | 11/2001 |
| JP | 2003-141179 | A | | 5/2003 |
| JP | 2004-227184 | A | | 8/2004 |
| JP | 2004-232343 | A | | 8/2004 |
| JP | 2009287298 | A | * | 12/2009 |
| JP | 2012-202063 | A | | 10/2012 |
| JP | 2016-190282 | A | | 11/2016 |
| WO | WO-2015/173920 | A1 | | 11/2015 |

* cited by examiner

FIG.2

D2

| No. | MEMBER | PIN HOLE | DESIGN DATA (CENTER POSITION) | WORKING DATA (CENTER POSITION) |
|---|---|---|---|---|
| 1 | BOOM | HOLE FOR FOOT PIN | (X10,Y10,Z10) | (X11,Y11,Z11) |
| 2 | | HOLE FOR CONNECTION WITH DIPPER STICK 120 | (X20,Y20,Z20) | (X21,Y21,Z21) |
| 3 | | HOLE OF ATTACHMENT PORTION FOR BOOM CYLINDER 111 (ON THE ROD SIDE) | (X30,Y30,Z30) | (X31,Y31,Z31) |
| 4 | | HOLE OF ATTACHMENT PORTION FOR DIPPER STICK CYLINDER 121 (ON THE BOTTOM SIDE) | (X40,Y40,Z40) | (X41,Y41,Z41) |
| 5 | DIPPER STICK | HOLE OF ATTACHMENT PORTION FOR DIPPER STICK CYLINDER 111 (ON THE ROD SIDE) | (X50,Y50,Z50) | (X51,Y51,Z51) |
| 6 | | A HOLE FOR CONNECTION WITH BOOM 110 | (X60,Y60,Z60) | (X61,Y61,Z61) |
| 7 | | HOLE OF ATTACHMENT PORTION FOR BUCKET CYLINDER 131 (ON THE BOTTOM SIDE) | (X70,Y70,Z70) | (X71,Y71,Z71) |

FIG.5

D5

| MACHINE NUMBER | DIMENSION L01 | DIMENSION L11 | DIMENSION L12 | DIMENSION L13 | DIMENSION L21 | DIMENSION L22 | DIMENSION L23 | DIMENSION L24 | DIMENSION L31 |
|---|---|---|---|---|---|---|---|---|---|
| A102001 | No.10001 | No.20001 | No.30001 | No.40001 | No.50001 | No.60001 | No.70001 | No.80001 | No.90001 |
| A102002 | No.10002 | No.20002 | No.30002 | No.40002 | No.50002 | No.60002 | No.70002 | No.80002 | No.90002 |
| A102003 | No.10003 | No.20003 | No.30003 | No.40003 | No.50003 | No.60003 | No.70003 | No.80003 | No.90003 |
| A102004 | No.10004 | No.20004 | No.30004 | No.40004 | No.50004 | No.60004 | No.70004 | No.80004 | No.90004 |
| ..... | ..... | ..... | ..... | ..... | ..... | ..... | ..... | ..... | ..... |

FIG.9

D9

| No. | DIMENSION | UNIT | DESIGN DATA | DIMENSION OBTAINED FROM SERVER DEVICE 200 |
|---|---|---|---|---|
| 1 | L01 | mm | ***6.5 | ***4.2 |
| 2 | L02 | mm | **3.1 | – |
| 3 | L11 | mm | ***1.2 | ***3.5 |
| 4 | L12 | mm | ***3.4 | ***5.1 |
| 5 | L13 | mm | ***8.4 | ***6.6 |
| 6 | L21 | mm | **7.6 | **6.9 |
| 7 | L22 | mm | ***4.2 | ***4.8 |
| 8 | L23 | mm | ***9.1 | ***8.7 |
| 9 | L24 | mm | **3.3 | **3.7 |
| 10 | L31 | mm | **2.9 | ***5.0 |
| 11 | L32 | mm | ***6.7 | – |
| 12 | L33 | mm | ***5.5 | – |
| 13 | L34 | mm | ***3.6 | – |
| 14 | Phibm | deg | **.7 | – |
| 15 | Phiam | deg | **.3 | – |
| 16 | Phibk | deg | **.2 | – |
| 17 | Lbms | mm | ***7.7 | – |
| 18 | Lams | mm | ***4.4 | – |
| 19 | Lbks | mm | ***2.8 | – |

FIG.10

D10

| No. | DIMENSION | DESIGN DATA | DIMENSION OBTAINED FROM SERVER DEVICE 200 | CALIBRATED DATA |
|---|---|---|---|---|
| 1 | L01 | | ***4.2 | **3.8 |
| 2 | L02 | ***3.1 | – | ***2.2 |
| 3 | L11 | | ***3.5 | ***3.7 |
| 4 | L12 | | ***5.1 | ***5.5 |
| 5 | L13 | | ***6.6 | ***6.4 |
| 6 | L21 | | **6.9 | **6.8 |
| 7 | L22 | | ***4.8 | ***4.1 |
| 8 | L23 | | ***8.7 | ***7.9 |
| 9 | L24 | | **3.7 | **3.1 |
| 10 | L31 | | ***5.0 | ***4.2 |
| 11 | L32 | ***6.7 | – | ***6.4 |
| 12 | L33 | ***5.5 | – | ***5.9 |
| 13 | L34 | ***3.6 | – | ***4.1 |
| 14 | Phibm | **.7 | – | **.9 |
| 15 | Phiam | **.3 | – | **.5 |
| 16 | Phibk | **.2 | – | **.8 |
| 17 | Lbms | ***7.7 | – | ***6.9 |
| 18 | Lams | ***4.4 | – | ***3.1 |
| 19 | Lbks | ***2.8 | – | ***3.4 |

WORK MACHINE SYSTEM AND CONTROL METHOD

TECHNICAL FIELD

The present invention relates to a work machine system and a control method.

BACKGROUND ART

Conventionally, an earthmoving machine which calculates the bucket's teeth position based on the length of a cylinder is known. For such an earthmoving machine, in order to calculate the teeth position accurately, it is necessary to previously calibrate design data used to calculate the teeth position. For this calibration, actual dimension data between the locations of predetermined portions of the earthmoving machine is used. This actual dimension data is obtained by using a measuring instrument on an earthmoving machine production line.

CITATION LIST

Patent Literature

PTL 1: Japanese Patent Laying-Open No. 2004-232343
PTL 2: Japanese Patent Laying-Open No. 2004-227184

SUMMARY OF INVENTION

Technical Problem

Obtaining actual dimension data using a measuring instrument, as described above, requires some manpower and some amount of working time.

An object of the present invention is to provide a work machine system and a control method capable of quickly obtaining data used to calculate a teeth position.

Solution to Problem

In one aspect of the present invention, a work machine system comprises a work machine having a work implement including a bucket, and a server capable of communicating with the work machine. The work machine transmits an identification number associated with the work machine to the server. The server device has an obtaining unit configured to obtain, based on the identification information, basic data used for calculating the position of teeth of the bucket, and a transmission unit configured to transmit the obtained basic data to the work machine.

Advantageous Effects of Invention

The present invention allows data used for calculation of a teeth position to be quickly obtained.

BRIEF DESCRIPTION OF DRAWINGS

FIG. 2 illustrates one example of design data and working data stored in a server device.

FIG. 5 represents a schematic configuration of a data table.

FIG. 9 generally represents data stored in a work vehicle.

FIG. 10 shows data for illustrating a calibration process and calibrated values.

DESCRIPTION OF EMBODIMENTS

Hereinafter, an embodiment will be described with reference to the drawings. In the following description, identical components are identically denoted. Their names and functions are also identical. Accordingly, they will not be described repeatedly. It is planned from the beginning to combine and use a configuration in an embodiment, as appropriate. Some components may not be used.

Hereinafter, a work machine system having a server device and a work machine will be described with reference to the drawings. Furthermore, a work vehicle as an example of the work machine will be described hereinafter. In the following, as a work vehicle, a hydraulic excavator will be described as an example. In particular, an information and communication technology (ICT) hydraulic excavator will be described as an example.

In the following description, "upper," "lower," "front," "rear," "right," and "left" are terms with reference to an operator seated on an operator's seat of the work vehicle.

<Outline of Process>

In the present embodiment, the server device receives a machine number from the work vehicle. Based on the machine number, the server device obtains from a data table stored in the server device a plurality of pieces of data used by the work vehicle for calculating the position of the teeth of the bucket. The server device transmits the obtained plurality of pieces of data to the work vehicle. Hereinafter, a variety of types of processing including such processing will more specifically be described with reference to the drawings.

<General Configuration>

Figure 1:
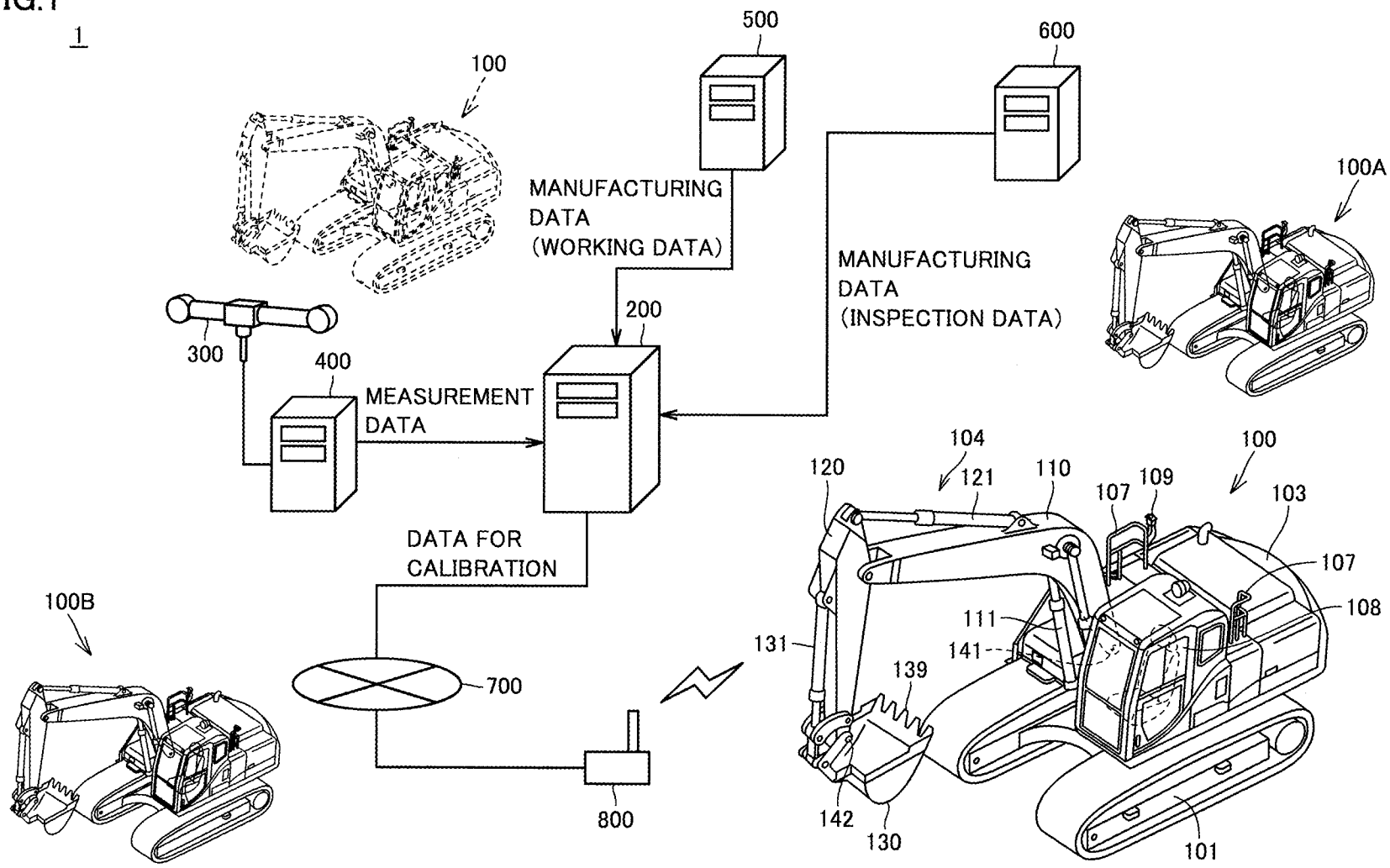
FIG. 1 is a diagram showing a schematic configuration of a work machine system based on an embodiment.

FIG. 1 is a diagram showing a schematic configuration of a work machine system based on an embodiment.

As shown in FIG. 1, a work machine system 1 comprises a plurality of work vehicles 100, 100A, 100B, a plurality of server devices 200, 400, 500, 600, a camera 300, and a transceiver 800. The number of work vehicles is not limited to three work vehicles.

Camera 300 and server device 400 are communicably connected. Server device 200 and server devices 400, 500, and 600 are communicably connected. Server device 200 is communicably connected to transceiver 800 via a network 700 such as the Internet.

Note that server device 200 is an example of a "server" in the present invention. Work vehicle 100 is an example of a "work machine" in the present invention.

(1) General Configuration of Work Vehicle 100

As shown in FIG. 1, work vehicle 100 mainly includes a travel unit 101, a revolving unit 103, a work implement 104, and a receiving antenna 109 for the Global Positioning Satellite System (GNSS). Work vehicle 100 has a main body composed of travel unit 101 and revolving unit 103. Travel unit 101 has a pair of right and left crawler belts. Revolving unit 103 is mounted via a revolving mechanism of an upper portion of travel unit 101 revolvably.

Work implement 104 is pivotally supported at revolving unit 103 so as to be movable upward and downward and performs a work such as excavation of soil. Work implement 104 includes as its components a boom 110, a dipper stick 120, a bucket 130, a boom cylinder 111, a dipper stick cylinder 121, and a bucket cylinder 131.

Boom 110 has a base movably coupled to revolving unit 103. Dipper stick 120 is movably coupled to the distal end of boom 110. Bucket 130 is movably coupled to the distal end of dipper stick 120. Revolving unit 103 includes an operator's cab 8 and a handrail 107. In the present example, receiving antenna 109 is attached to handrail 107.

Boom 110 is driven by boom cylinder 111. Dipper stick 120 is driven by dipper stick cylinder 121. Bucket 130 is driven by bucket cylinder 131.

Work implement 104 of work vehicle 100 is an example of a "work implement" in the present invention. Bucket 130 of work vehicle 100 is an example of a "bucket" in the present invention.

Work vehicles 100A, 100B have the same hardware configuration as work vehicle 100, and accordingly, their hardware configuration will not be described repeatedly. The following description will mainly focus on work vehicle 100 among the plurality of work vehicles 100, 100A, 100B.

(2) Three-Dimensional Measurement

Camera 300 is a camera for three-dimensional measurement. Camera 300 has a dual camera sensor. Camera 300 previously images work vehicle 100 having a plurality of predetermined portions each with a reflector attached thereto and thus obtains image data, and sends the image data to server device 400. In the present example, the reflectors are attached to receiving antenna 109, the teeth of bucket 130, a foot pin 141, and a bucket pin 142.

Server device 400 has software pre-installed therein for obtaining three-dimensional data (3D data). Server device 400 calculates three-dimensional coordinate data of the reflectors based on the three-dimensional image data sent from camera 300 (hereinafter also referred to as "measurement data"). Thus, measurement data is obtained from image data.

Figure 6:
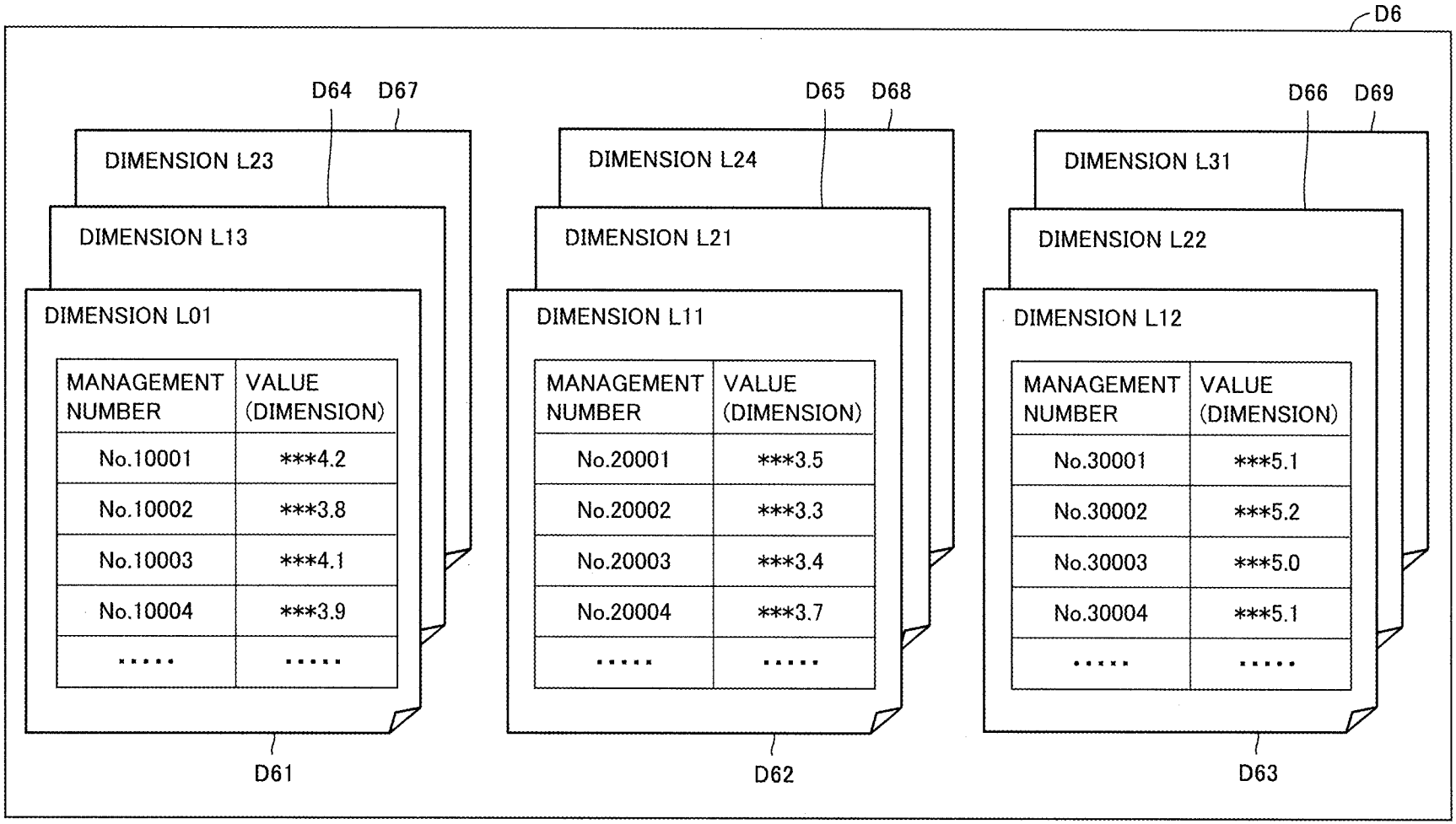
FIG. 6 represents a schematic configuration of a data table.

Server device 400 calculates three-dimensional coordinate data of the reflectors for each of a plurality of work vehicles 100. Server device 400 associates the coordinate data with a management number associated with the machine number of the work vehicle and thus stores the data. In response to a request from server device 200, server device 400 associates coordinate data with a management number and thus transmits the coordinate data to server device 200. A management number is an identification number, and a specific example thereof will be described hereinafter (FIG. 5, FIG. 6).

While in the example of the present embodiment a configuration will be described in which server device 200 calculates actual dimension data from measurement data by way of example, this is not exclusive. In place of server device 200, server device 400 may calculate actual dimension data from measurement data. In that case, server device 400 may transmit the actual dimension data instead of the measurement data to server device 200.

(3) Manufacturing Data

Server devices 500 and 600 associate manufacturing data of components included in work implement 104 with a management number associated with the machine number of a work vehicle, and thus store the manufacturing data therein. The manufacturing data includes actual machining data obtained through machining (hereinafter also referred to as "working data"), and inspection data obtained by inspecting a product.

The working data is data representing an actual working position in machining and it is different from design data. Machining is typically performed by a machine tool (not shown).

Server device 500 associates working data of components included in work implement 104, such as boom 110 and dipper stick 120, with a management number, and thus stores the working data therein. Server device 500 stores therein for example the position (or coordinate data) of a pin hole as the working data described above.

In response to a request from server device 200, server device 500 associates coordinate data as working data with a management number and thus transmits the coordinate data to server device 200.

Server device 600 associates inspection data of components included in work implement 104, such as boom cylinder 111, dipper stick cylinder 121, bucket cylinder 131, etc., with a management number associated with the machine number of work vehicle 100 to which these cylinders are to be attached, and thus stores the inspection data therein. Server device 600 stores actual measurement data therein as the inspection data.

For example, server device 600 stores therein as the actual measurement data the cylinder lengths that these cylinders have when they are maximally extended and the cylinder lengths that they have when they are maximally contracted.

In response to a request from server device 200, server device 600 associates actual measurement data as inspection data with a management number and thus transmits the actual measurement data to server device 200.

(4) Generating Actual Dimension Data

Server device 200 associates measurement data (coordinate data) obtained from server device 400, working data (coordinate data) obtained from server device 500, and inspection data (actual measurement data) obtained from server device 600 with a management number associated with the machine number of work vehicle 100, and thus manages the data. By such processing, server device 200 will manage data of a plurality of work vehicles 100 individually. How server device 200 manages data will more specifically be described hereinafter (FIGS. 5 and 6).

Server device 200 calculates actual dimension data from measurement data. Server device 200 also calculates actual dimension data from working data. As will more specifically be described hereinafter, server device 200 calculates a length between two coordinates (actual dimension data) based on coordinate data.

In response to a request from work vehicle 100, server device 200 transmits actual dimension data of the requester work vehicle 100 to the requester work vehicle 100 as data for calibration.

(5) Outline of Calibration Process

Work vehicle 100 obtains data from server device 200 for calibration of the work vehicle. Work vehicle 100 uses the data for calibration to calibrate design data used to calculate the teeth position. Specifically, work vehicle 100 uses data used for calibration and representing a dimension to change a plurality of default values (a designed dimension and a design angle) used to calculate the position of the teeth. The calibration process will more specifically be described hereinafter.

<Design Data and Working Data>

Before more specifically describing the calibration process, design data and working data of predetermined components included in work vehicle 100 will be described.

FIG. 2 illustrates one example of design data and working data stored in server device 500.

As shown in FIG. 2, in data D2, design data and working data are stored in association with each of pin holes of boom 110 and dipper stick 120. Further, server device 500 associates such data D2 with a management number associated with the machine number of work vehicle 100 and thus stores the data for each work vehicle. In the example of data D2, the design data and the working data represent the center position of a pin hole. In the present example, the design data representing the center position is per se not calibrated; rather, a dimension between two such center positions (design data) is calibrated.

Note that the design data is the same for the same type of work vehicles, and accordingly, it may not be directly associated with the working data, as shown in FIG. 2.

Figure 3:
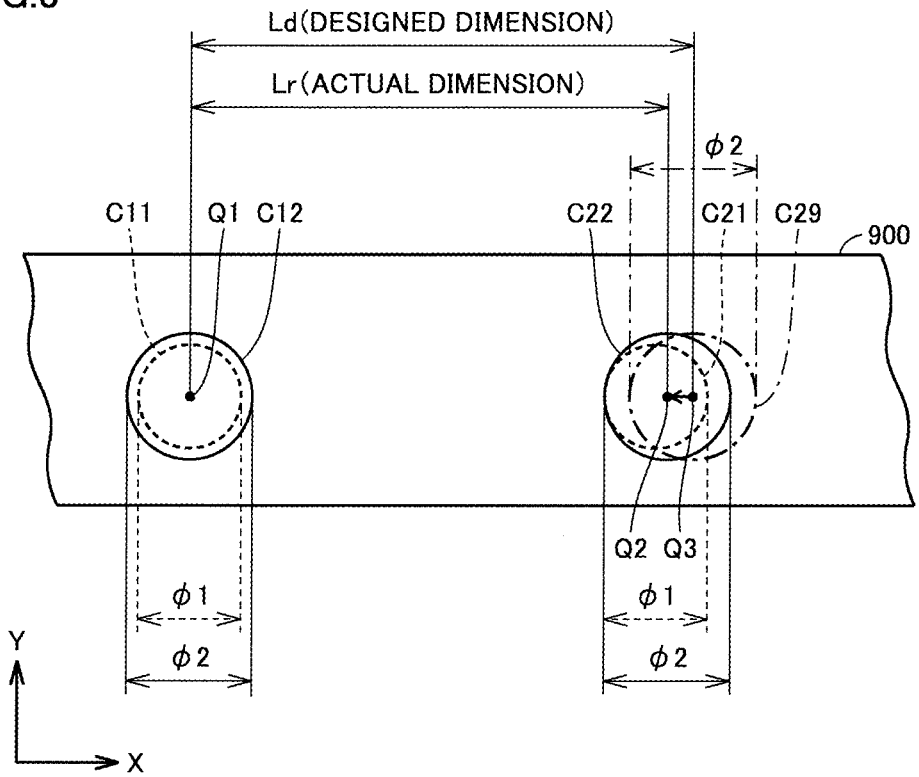
FIG. 3 illustrates a reason why working data is offset from design data.

FIG. 3 illustrates a reason why the working data is offset from the design data.

As shown in FIG. 3, a case where two holes C12 and C22 of a diameter of φ2 are formed in a casting 900 will be described as an example. Casting 900 corresponds to boom 110 and dipper stick 120.

Casting 900 has two pilot holes C11 and C21 of a diameter φ1 already formed before two holes C12 and C22 of a diameter φ2 are formed with a machine tool (when the casting is completed).

The two holes to be formed based on pilot holes C11 and C21 have design data with center positions Q1 and Q3 having coordinate values of (Xa, Ya) and (Xc, Yc), respectively, for the sake of illustration. Further, pilot hole C11 has center position Q1 having coordinates (Xa, Ya) and pilot hole C21 has a center position offset from center position Q3 of the design data for the sake of illustration.

In that case, the center position of pilot hole C11 matches the center position of the design data, and the machine tool can match the center position of hole C12 with center position Q1 of pilot hole C11. However, the center position of pilot hole C21 does not match center position Q3 of the design data, and, depending on the relationship between φ1 and φ2, the machine tool cannot form a hole having a diameter of φ2 (a round hole) with Q3 (Xc, Ye) serving as a center. Therefore, the machine tool forms a hole having a diameter of φ2 with Q2 (Xb, Yb) serving as a center. Note that center position Q2 is a position which allows a hole of diameter φ2 to be formed and provides a shortest distance from center position Q3 of the design data.

Thus, center position Q3 of the design data and center position Q2 of the working data will be different positions. Thus, the working data is offset from the design data.

Note that such a process which changes the position of a hole from the design data is previously defined by an NC program in the machine tool. Further, the machine tool stores the working data therein, and the working data is transmitted to server device 500 or the like.

<Details of Calibration Process>

As has been described above, main controller 150 (see FIG. 11) of work vehicle 100 uses data used for calibration and representing a plurality of dimensions (actual dimension data) to calibrate a plurality of pieces of design data used to calculate the position of teeth 139. The design data includes dimension (or length) and angle.

Main controller 150 performs calibration using actual dimension data transmitted from server device 200 and known design data (a portion of a plurality of pieces of design data). As an example, it is assumed that 19 values (dimensional and angular values) are required to calculate the position of teeth 139. For some of the 19 values, main controller 150 does not use the design data and instead uses the actual dimension data obtained from server device 200 and, for the remainder, uses the design data per se to thus calibrate the 19 values (the design data). This process will be described in a specific example with reference to FIGS. 9 and 10.

In the following, for the sake of illustration, a case will be described by way of example in which a plurality of pieces of design data are calibrated without using inspection data (actual measurement data of cylinder length) obtained from server device 600. It is also possible as a matter of course to use inspection data obtained from server device 600.

Figure 4:
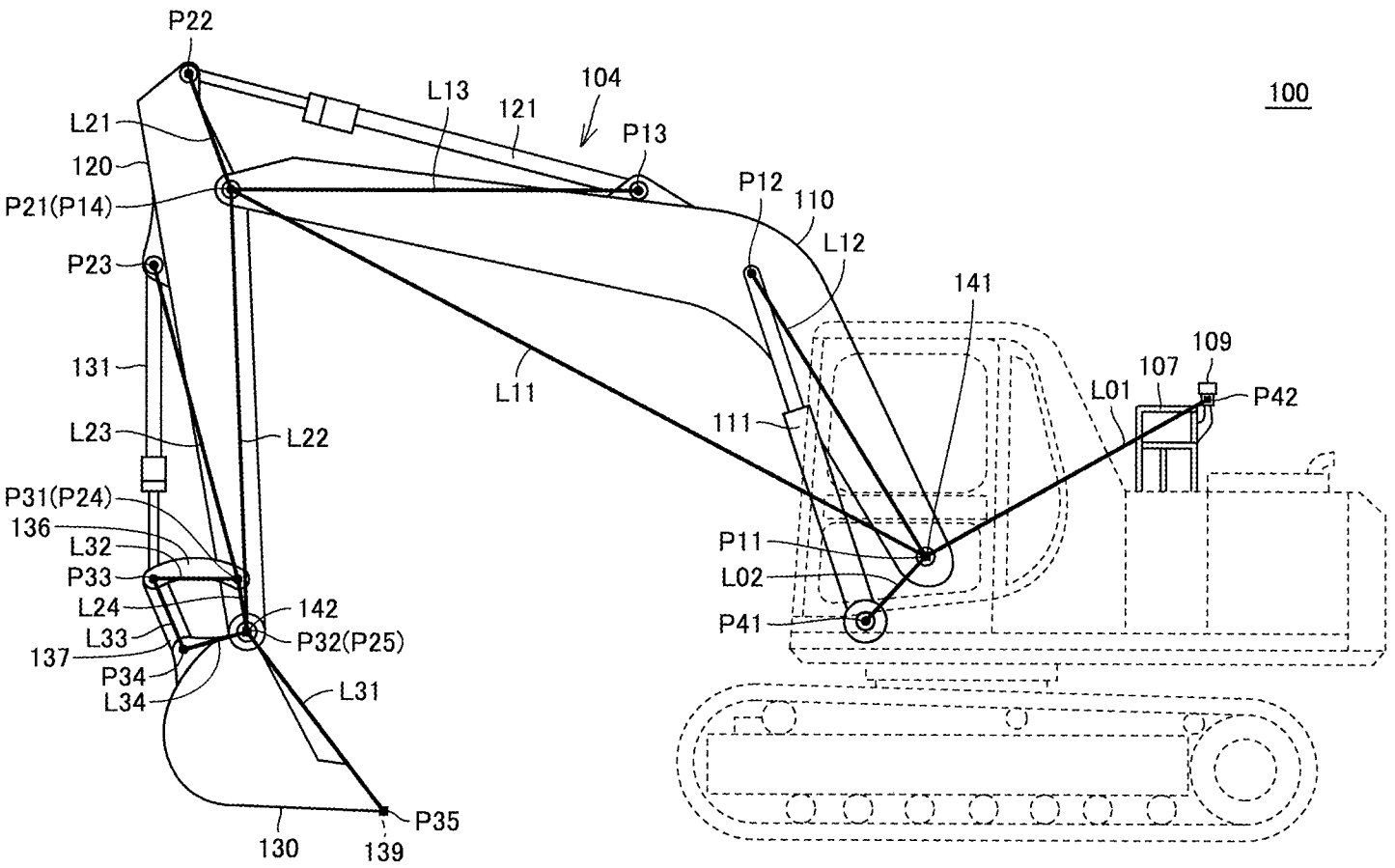
FIG. 4 is a diagram for illustrating some of dimensions used for calculating the position of teeth.

FIG. 4 is a diagram for illustrating some of dimensions used for calculating the position of teeth 139. In the following, parts for which actual dimension data is used and those for which design data is used will separately be described. Further, the actual dimension data is divided into measurement data obtained via server device 400 and working data obtained via server device 500 in the following description. It should be noted that the following is only an example and the present invention is not limited thereto.

(1) Parts for Which a Working Data-Based Dimension (or Actual Dimension Data) is Used Initially, dimensions for boom 110 will be described. As shown in FIG. 4, main controller 150 in performing calibration uses working data-based dimensions for a distance L11 between positions P11 and P14, a distance L12 between positions P11 and P12, and a distance L13 between positions P13 and P14.

Position P11 is the position of the hole receiving foot pin 141 for attaching boom 110 to the body of the work vehicle. Further, a reflector is attached to foot pin 141, as has been described above. Therefore, position P11 is also the position of the reflector attached to foot pin 141. Position P12 is a position where a pin is inserted for fixing the rod of boom cylinder 111 to boom 110. Position P13 is a position where a pin is inserted for fixing the bottom of dipper stick cylinder 121 to boom 110. Position P14 is a position where a pin is inserted for connecting dipper stick 120 to boom 110.

Dimensions for dipper stick 120 will be described. Main controller 150 uses working data-based dimensions for a distance L21 between positions P21 and P22, a distance L22 between positions P21 and P25, a distance L23 between positions P23 and P24, and a distance L24 between positions P24 and P25.

Position P21 is a position where a pin is inserted for connecting dipper stick 120 to boom 110. Position P22 is a position where a pin is inserted for fixing the rod of dipper stick cylinder 121 to dipper stick 120. Position P23 is a position where a pin is inserted for fixing the bottom of bucket cylinder 131 to dipper stick 120. Position P24 is a position where a pin is inserted for fixing one end of a link mechanism 136 of bucket 130 to dipper stick 120. Link mechanism 136 has the other end connected to the tip of the rod of bucket cylinder 131 by a pin. Position P25 is a position where bucket pin 142 is inserted for connecting dipper stick 120 to bucket 130.

Thus, when main controller 150 performs calibration, main controller 150 does not use the design data and instead uses a dimension calculated based on the working data (actual dimension data) for distances L11, L12, L13, L21, L22, L23, L24.

(2) Parts for Which a Measurement Data-Based Dimension (Actual Dimension Data) is Used For bucket 130 and the body of the working vehicle, dimensions based on measurement data obtained by imaging through camera 300 are used.

Specifically, main controller 150 in performing calibration uses measurement data-based dimensions for a distance L01 between positions P11 and P42 and a distance L31 between positions P32 and P35.

Position P42 is the position of the reflector attached to a predetermined portion of receiving antenna 109. Position P32 is the position of the reflector attached to bucket pin 142. Position P35 is the position of the reflector attached to a predetermined portion of teeth 139 of bucket 130. A reflector may be attached to a contour point of bucket 130.

Measurement data-based dimensions are used for distances L01 and L31 for the following reason:

Bucket 130 is replaced with another type of bucket 130 different in distance L31 by the user depending on the specific contents of the work of interest. Further, teeth 139 is welded or bolted to an end of the body of the bucket after the bucket's body is completed by machining. For this reason, if a working data-based dimension is used as distance L31, the position of teeth 139 cannot be calculated accurately.

In addition, receiving antenna 109 is installed at a final stage of a process for assembling the work vehicle, and accordingly, using the measurement data allows the position of teeth 139 to be calculated more accurately than using the working data.

For these reasons, measurement data-based dimensions are used for distances L01 and L31.

(3) Parts for Which Design Data (Default Data) is Used

Main controller 150 in performing calibration uses default data for a distance L02 between positions P11 and P41, a distance L32 between positions P32 and P33, a distance L33 between positions P33 and P34, and a distance L34 between positions P32 and P34.

Position P41 is a position where a pin is inserted for connecting the bottom of boom cylinder 111 to the body of the work vehicle. Position P32 is a position where a pin is inserted for connecting bucket 130 to dipper stick 120.

Position P33 is a position where a pin is inserted for fixing one end of link mechanism 136 of bucket 130 and one end of a link mechanism 137 of bucket 130 to the rod of bucket cylinder 131. Position P34 is a position where a pin is inserted for fixing the other end of link mechanism 137 to the bottom of bucket 130.

<Server Device 200>

(1) Outline of Process

Server device 200 uses working data (coordinate data) to calculate distances L11, L12, L13, L21, L22, L23, L24 (see FIG. 4). Further, server device 200 uses image data (coordinate data) to calculate distances L01 and L31 (see FIG. 4).

Server device 200 manages the calculated distances (actual dimensions) by using the following data table D5 and data table D6 stored in server device 200.

Note that distance L01 is a dimension used for calculating the position of teeth 139, and accordingly, in the following, it will also be represented as "dimension L01." The other distances L11, L12, L13, L21, L22, L23, L24 and L31 are also represented in a manner similar to that in which distance L01 is represented.

FIG. 5 represents a schematic configuration of data table D5.

As shown in FIG. 5, management numbers for nine dimensions are associated with each of the machine numbers of a plurality of work vehicles. For example, a management number "No. 10001" for dimension L01, a management number "No. 20001" for dimension L02, a management number "No. 30001" for dimension L03, etc. are associated with a machine number "A102001." Further, a management number "No. 10002" for dimension L01, a management number "No. 20002" for dimension L02, a management number "No. 30002" for dimension L03, etc. are associated with a machine number "A102002."

Association between a machine number and each management number is determined at a production planning stage of work vehicle 100. Further, each data (a machine number and a management number for each dimension) for data table D5 is input for example by the manufacturer of work vehicles or the like.

When a machine number is designated, server device 200 can refer to data table D5 to obtain each management number of nine dimensions associated with the designated machine number.

In the following, for the sake of illustration, "A102001" serves as a machine number of work vehicle 100 by way of example. Further, "A102002" and "A102003" are respectively a machine number of work vehicle 100A and a machine number of work vehicle 100B. The machine number "A102001" is an example of "identification information" in the present invention.

FIG. 6 represents a schematic configuration of data table D6.

As shown in FIG. 6, data table D6 includes a plurality of data tables D61, D62, D63, D64, D65, D66, D67, D68, D69.

In data table D61, a measurement data-based dimension (an actual dimension of distance L01) is associated with each management number for dimension L01. Further, in data table D62, a dimension calculated based on coordinate data (an actual dimension of distance L11) is associated with each management number for dimension L11. In data table D63, a dimension calculated based on coordinate data (an actual dimension of distance L12 is associated with each management number for dimension L12.

Similarly, in data tables D64 to D69, a dimension calculated based on coordinate data is associated with each management number for the respective dimensions. Further, a measurement data-based dimension (an actual dimension of distance L31) is associated with each management number for dimension L31.

Thus, in data table D6, a dimension (an actual dimension) is associated with each of the management numbers shown in data table D5 of FIG. 5. Therefore, once a management number is designated, server device 200 can refer to data table D6 to obtain a dimension associated with the designated management number.

Thus, once a machine number is designated, server device 200 can refer to data tables D5 and D6 to obtain a dimension associated with each of the nine management numbers associated with the designated machine number.

For example, when the machine number "A102001" (see FIG. 5) is designated, server device 200 refers to data table D5 and obtains nine management numbers "No. 10001," "No. 20001," "No. 310001," . . . , "No. 90001" from a plurality of management numbers included in data table D5.

Once the nine management numbers are obtained, server device 200 refers to data table D6 (see FIG. 6) and obtains from a plurality of dimensions included in data table D6 nine dimensions associated with the obtained management numbers.

Note that a machine number is designated from each of the plurality of work vehicles. A machine number is sent to server device 200 from, for example, each work vehicle 100, 100A, 100B. Server device 200 transmits nine dimensions obtained from data table D6 to a work vehicle that has transmitted a machine number.

In that case, server device 200 associates the obtained nine dimensions with identifiers allowing the work vehicle to identify each dimension form the other dimensions, and thus transmits the nine dimensions to the work vehicle. For example, server device 200 associates each obtained dimension with that dimension's dimension name (e.g., "L01") and transmits it to the work vehicle.

Thus, the work vehicle having received 9 dimensions can obtain actual dimension data for the vehicle (i.e., distances L11, L12, L13, L21, L22, L23, L24, L01, L31) used for calibrating a plurality of pieces of design data (the 19 dimensions shown in FIG. 10) used for calculating the teeth position (see FIG. 9 and FIG. 10).

It should be noted that the data structure of data table D6 shown in FIG. 6 is only an example and the present invention is not limited thereto. Associating a management number with a dimension for each of dimensions L01, L11, . . . suffices.

When each work vehicle 100, 100A, 100B uses actual measurement data of cylinder length to calibrate a plurality of pieces of design data, server device 200 will also obtain actual measurement data as actual dimension data for each work vehicle 100, 100A, 100B. In that case, in data table D5, a machine number and a management number for a dimension for cylinder length may be associated, and in data table D6, the management number and actual measurement data may be associated.

Note that each value shown in FIG. 6 (e.g., "***4.2") is an example of "basic data" in the present invention.

(2) Functional Configuration

Figure 7:
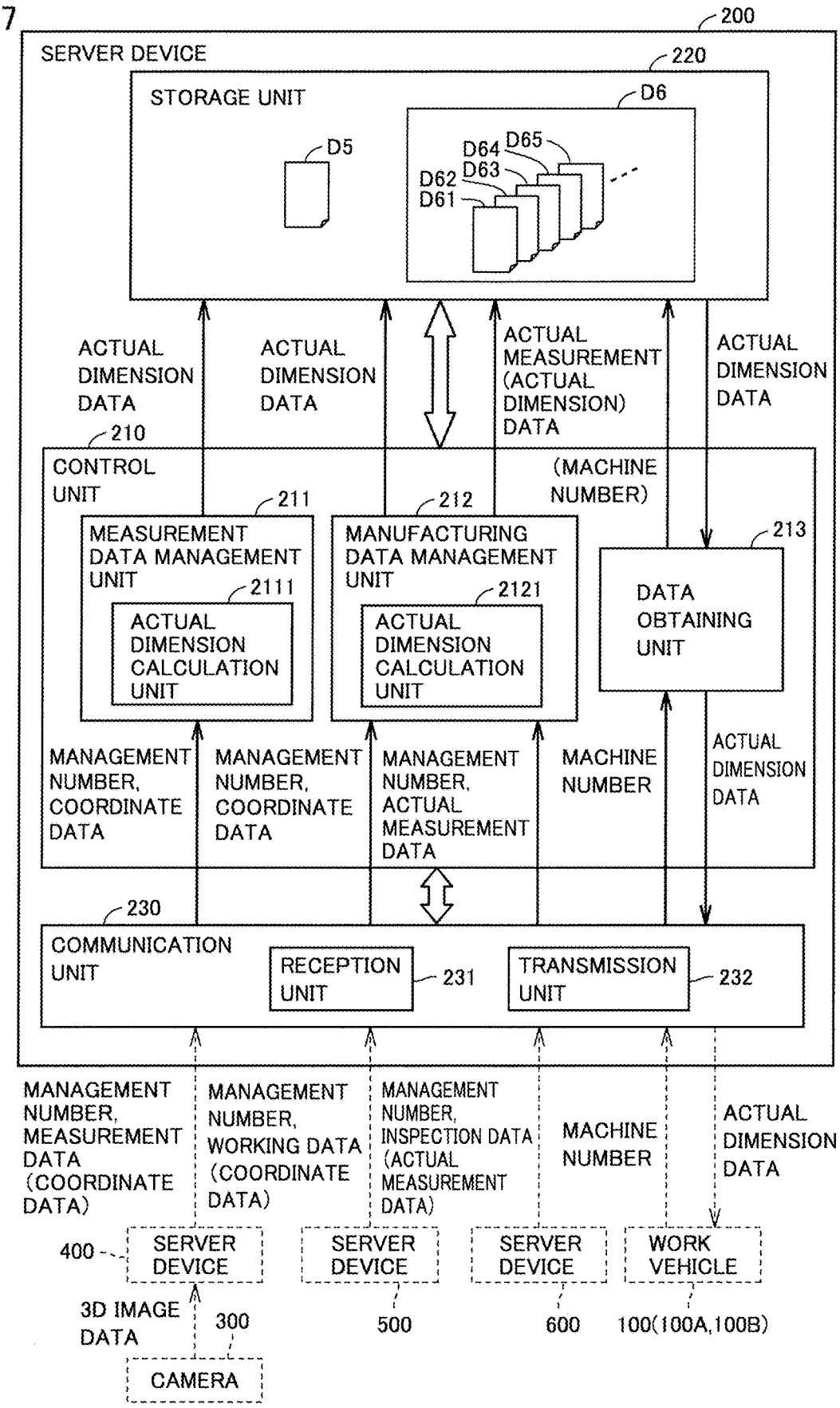
FIG. 7 is a functional block diagram representing a functional configuration of a server device.

FIG. 7 is a functional block diagram representing a functional configuration of server device 200.

As shown in FIG. 7, server device 200 comprises a control unit 210, a storage unit 220, and a communication unit 230. Control unit 210 includes a measurement data management unit 211, a manufacturing data management unit 212, and a data obtaining unit 213. Measurement data management unit 211 has an actual dimension calculation unit 2111. Manufacturing data management unit 212 has an actual dimension calculation unit 2121. Storage unit 220 stores data table D5 and data table D6 therein.

Control unit 210 generally controls server device 200. Control unit 210 is implemented by a processor, which will be described hereinafter, running and executing an operating system and a program, respectively, stored in a memory.

Communication unit 230 is an interface for communicating with server devices 400, 500, 600, and work vehicles 100, 100A, 100B. Communication unit 230 includes a reception unit 231 which receives data, and a transmission unit 232 which transmits data. Reception unit 231 receives measurement data (coordinate data) from server device 400 to which camera 300 is connected. Reception unit 231 receives manufacturing data from server devices 500 and 600.

Measurement data management unit 211 receives measurement data from server device 400 and manages the received measurement data based on a management number obtained from server device 400 together with the measurement data. Actual dimension calculation unit 2111 of measurement data management unit 211 calculates dimensions (actual dimensions) of distances L01 and L31 (see FIG. 4) based on measurement data (coordinate data). Note that, as has been described above, for a configuration in which server device 400 calculates a dimension, measurement data management unit 211 does not need to include actual dimension calculation unit 2111.

Measurement data management unit 211 writes a calculated dimension in a dimension data field in data table D6 that corresponds to the received management number. For example, when the received management number is "No. 10001," measurement data management unit 211 writes the calculated dimension in data table D61 for dimension L01 (see FIG. 6) at a dimension field corresponding to No. 10001 (i.e., in FIG. 6, a field in which "****4.2" is written).

Manufacturing data management unit 212 receives working data (coordinate data) from server device 500 and manages the received working data based on a management number received from server device 500 together with the working data. Actual dimension calculation unit 2121 of manufacturing data management unit 212 uses the working data (coordinate data) to calculate dimensions (actual dimensions) of distances L11, L12, L13, L21, L22, L23, L24 (see FIG. 4).

Manufacturing data management unit 212 writes a calculated dimension in a dimension data field in data table D6 that corresponds to the received management number. For example, when the received management number is "No. 20001," manufacturing data management unit 212 writes the calculated dimension in data table D62 for dimension L11 (see FIG. 6) at a dimension field corresponding to No. 20001 (i.e., in FIG. 6, a field in which "****3.5" is written).

Furthermore, manufacturing data management unit 212 receives inspection data (actual measurement data) from server device 600 and manages the received inspection data based on a management number received from server device 600 together with the inspection data. Manufacturing data management unit 212 writes the received dimension (the actual measurement data's value) in data table D6 configured such that actual measurement data is associated with a management number for dimension for cylinder length, at a dimension data field corresponding to the obtained management number.

Data tables D61 to D69 shown in FIG. 6 are generated by such writing.

Hereinafter, a process performed by data obtaining unit 213 will be described.

Data obtaining unit 213 obtains machine numbers from the plurality of work vehicles 100, 100A, 100B via communication unit 230. For example, when data obtaining unit 213 obtains the machine number "A102001" of work vehicle 100, data obtaining unit 213 refers to data table D5 stored in storage unit 220 and obtains from a plurality of management numbers in data table D5 the management numbers for the nine dimensions associated with "A102001."

Data obtaining unit 213 refers to data table D6 and further obtains from a plurality of dimensions in data table D6 the dimensions associated with the obtained nine management numbers (that is, numerical values used for calculating the position of teeth 139).

Transmission unit 232 associates the nine dimensions obtained by data obtaining unit 213 with the identifiers of the dimensions, and thus transmits the nine dimensions to work vehicle 100 that is the sender of the machine number "A102001." Thus, work vehicle 100 can obtain actual dimension data for the vehicle (i.e., distances L11, L12, L13, L21, L22, L23, L24, L01, L31) used for calibrating a plurality of pieces of design data (the 19 values shown in FIG. 10) used for calculating the teeth position.

Thus, when server device 200 receives a machine number of work vehicle 100, server device 200 transmits to work vehicle 100 a plurality of pieces of data used for calculating the position of teeth 139 of work vehicle 100.

Thus, according to work machine system 1, work vehicle 100 can obtain a plurality of pieces of data used for calculation of the position of teeth 139, all at once, simply by transmitting a machine number. Therefore, work machine system 1 allows a plurality of pieces of data used for calculating the position of teeth 139 of work vehicle 100 to be obtained quickly.

Control unit 210 is an example of a "control unit" in the present invention. Data obtaining unit 213 is an example of an "obtaining unit" in the present invention. Transmission unit 232 is an example of a "transmission unit" in the present invention. Storage unit 220 is an example of a "storage unit" in the present invention.

(3) Hardware Configuration

Figure 8:
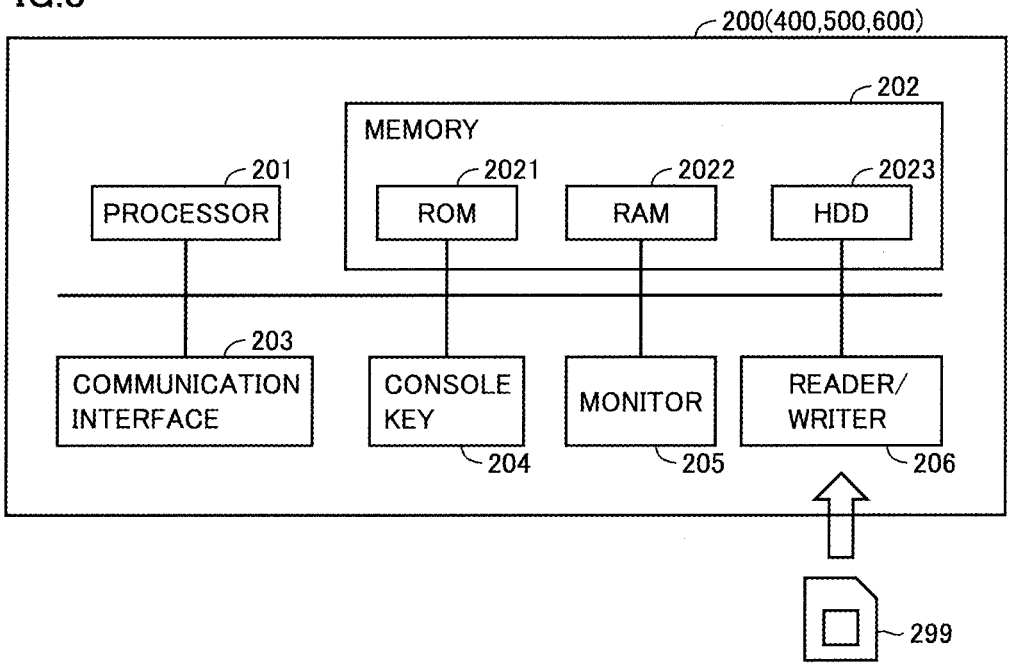
FIG. 8 represents a hardware configuration of a server device.

FIG. 8 represents a hardware configuration of server device 200.

As illustrated in FIG. 8, server device 200 includes a processor 201, a memory 202, a communication interface 203, a console key 204, a monitor 205, and a reader/writer 206. Memory 202 typically includes a ROM 2021, a RAM 2022, and an HDD (Hard Disc) 2023. Reader/writer 206 reads a variety of types of data including a program from a memory card 299 as a storage medium and writes data in memory card 299.

Processor 201 corresponds to control unit 210 shown in FIG. 8. More specifically, control unit 310 is implemented by processor 201 executing a program stored in memory 202. Memory 202 corresponds to storage unit 220 in FIG. 8. Communication interface 203 corresponds to communication unit 230 in FIG. 8.

Processor 201 executes a program stored in memory 202. RAM 2022 temporarily stores various programs, data generated by processor 201 executing a program, and data input by a user. ROM 2021 is a non-volatile storage medium, and typically stores a BIOS (Basic Input Output System) and firmware. HDD 2023 stores an OS (operating system), various application programs, and the like.

Software such as a program or the like stored in memory 202 may be stored in a memory card or another storage medium and distributed as a program product. Alternatively, the software may be provided as a downloadable program product by an information provider connected to the so-called Internet. Such software is read from the storage medium by a memory card reader/writer or another reader device or downloaded via an interface, and subsequently, temporarily stored in RAM 2022. The software is read from RAM 2022 by processor 201, and is further stored in HDD 2023 in the form of an executable program. Processor 201 executes the program.

Each component constituting server device 200 shown by the figure is a generally used component. Therefore, an essential part of the present invention can be said to be software stored in memory 202, a memory card or another storage medium, or software downloadable via a network.

The storage medium is not limited to a DVD (Digital Versatile Disc)-ROM, a CD (Compact Disc)-ROM, an FD (Flexible Disk) or a hard disk. For example, it may be magnetic tape, cassette tape, an optical disc (MO (Magnetic Optical Disc)/MD (Mini Disc)), an optical card, a mask ROM, EPROM (Electronically Programmable Read-Only Memory), EEPROM (Electronically Erasable Programmable Read-Only Memory), a flash ROM or a similar semiconductor memory which is a medium carrying a program in a fixed manner. Furthermore, the storage medium is a non-transitory medium allowing a computer to read a program and the like therefrom, and does not include a transitory medium such as a carrier wave.

Furthermore, a program as referred to herein includes not only a program directly executable by processor 201 but also a program in the form of a source program, a compressed program, an encrypted program, and the like.

Server devices 400, 500, and 600 have the same hardware configuration as server device 200, and accordingly, their hardware configuration will not be described repeatedly.

<Work Vehicle 100>

(1) Data

FIG. 9 generally represents data D9 stored in work vehicle 100.

As shown in FIG. 9, in data D9, design data and a dimension which work vehicle 100 has obtained from server device 200 are associated and thus stored.

In data D9, as the design data, 19 values of Nos. 1 to 19 are stored. The design data includes a designed dimension, and in addition, a designed angle for boom 110, a designed angle for dipper stick 120, a designed angle for bucket 130, and the like.

The dimension which work vehicle 100 has obtained from server device 200 includes a working data-based dimension (an actual dimension) and an image data (measurement data)-based dimension (an actual dimension). Of the dimensions obtained from server device 200, dimensions of Nos. 3 to 9 are working data-based dimensions. Of the dimensions obtained from server device 200, dimensions of Nos. 1 and 10 are image data-based dimensions.

FIG. 10 shows data D10 for illustrating the calibration process and calibrated values.

As shown in FIG. 10, main controller 150 obtains actual dimensions from server device 200 for distances L01, L11, L12, L13, L21, L22, L22, L24, L31.

Therefore, main controller 150 in performing the calibration uses the actual dimensions for distances L01, L11, L12, L13, L21, L22, L23, L24, L31. Further, main controller 150 uses the design data for the other values (distances L02, L32, L33, L34, Lbms, Lams, Lbks, and angles Phibm, Phiam, Phibk). Distances Lbms, Lams, and Lbks are values for boom cylinder 111, dipper stick cylinder 121, and bucket cylinder 131, respectively. Angles Phibm, Phiam, and Phibk are values for boom 110, dipper stick 120, and bucket 130, respectively.

Main controller 150 uses these 19 values (the actual dimension data and the design data) to calibrate the 19 pieces of design data (or default values). Main controller 150 thus obtains calibrated values. The calculation employs the same calculation method as used when a conventional measuring instrument such as a total station is used, and accordingly, it will not be described herein.

(2) Hardware Configuration

Figure 11:
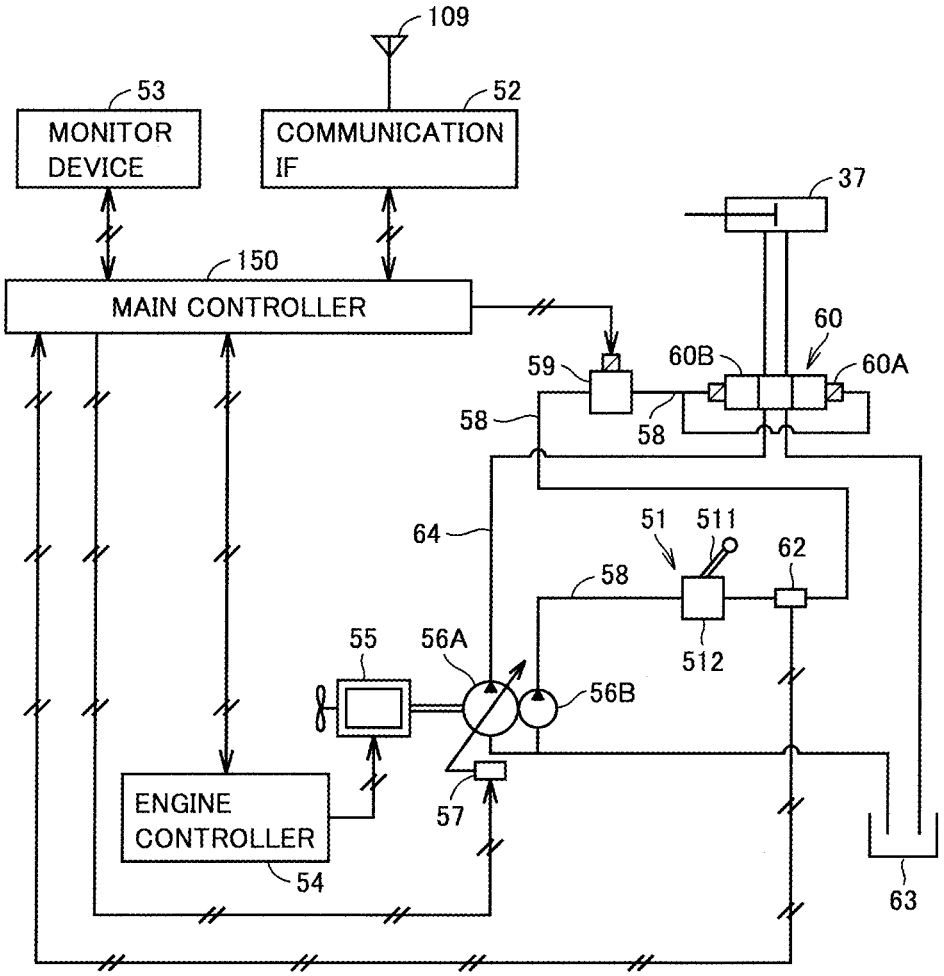
FIG. 11 represents a hardware configuration of a work vehicle.

FIG. 11 represents a hardware configuration of work vehicle 100,

As shown in FIG. 11, work vehicle 100 includes a cylinder 37, an operation device 51, a communication interface (IF) 52, a monitor device 53, an engine controller 54, an engine 55, a main pump 56A, and a pilot pump 56B, a swash plate drive device 57, a pilot oil path 58, an electromagnetic proportional control valve 59, a main valve 60, a pressure sensor 62, a tank 63, a hydraulic oil path 64, receiving antenna 109, and main controller 150.

Note that cylinder 37 represents any one of boom cylinder 111, dipper stick cylinder 121, and bucket cylinder 131. Cylinder 37 drives one of boom 110, dipper stick 120 and bucket 130.

Operation device 51 includes a control lever 511 and an operation detector 512 that detects an amount of operating control lever 511. Main valve 60 has a spool 60A and a pilot chamber 60B.

Operation device 51 is a device for operating work implement 104. In the present example, operation device 51 is a hydraulic device. Operation device 51 receives oil from pilot pump 56B.

Pressure sensor 62 senses the pressure of the oil discharged from operation device 51. Pressure sensor 62 outputs a sensed result to main controller 150 as an electrical signal.

Engine 55 has a drive shaft for connecting to main pump 56A and pilot pump 56B. As engine 55 rotates, main pump 56A and pilot pump 56B discharge hydraulic oil.

Engine controller 54 controls an operation of engine 55 in accordance with an instruction issued from main controller 150.

Main pump 56A supplies through hydraulic oil path 64 hydraulic oil used to drive work implement 104. Swash plate drive device 57 is connected to main pump 56A. Pilot pump 56B supplies hydraulic oil to electromagnetic proportional control valve 59 and operation device 51.

Swash plate drive device 57 is driven in response to an instruction received from main controller 150 to change an inclination angle of the swash plate of main pump 56A.

Monitor device 53 is communicably connected to main controller 150. Monitor device 53 notifies main controller 150 of an instruction input by the operator. Monitor device 53 displays a variety of indications in response to an instruction received from main controller 150.

Main controller 150 is a controller that generally controls work vehicle 100, and composed of a central processing unit (CPU), a non-volatile memory, a timer, and the like. Main controller 150 controls engine controller 54 and monitor device 53.

Main controller 150 receives an electrical signal from pressure sensor 62. Main controller 150 generates a command current according to the electrical signal. Main controller 150 outputs the generated command current to electromagnetic proportional control valve 59.

Main controller 150 calculates positional information of teeth 139 of bucket 130 based on a variety of types of information such as the vehicular body's positional information obtained via receiving antenna 109 for GNSS, a stroke length of cylinder 37, and information from an inertial sensor unit (not shown) incorporated in the vehicular body. Main controller 150 matches the positional information to execution design data and accordingly controls the operation of work implement 104 (boom 110, dipper stick 120, bucket 130) so as not to damage a design surface. When main controller 150 determines that teeth 139 has reached the design surface, main controller 150 automatically stops work implement 104 or moves teeth 139 along the design surface via an assistive function.

Further, main controller 150 performs the above-described calibration process to calculate the accurate position of teeth 139.

Electromagnetic proportional control valve 59 is provided in pilot oil path 58 connecting pilot pump 56B and pilot chamber 60B of main valve 60, and uses hydraulic pressure supplied from pilot pump 56B to generate command pilot pressure in accordance with a command current provided from main controller 150.

Main valve 60 is provided between electromagnetic proportional control valve 59 and cylinder 37. Main valve 60 adjusts the flow rate of the hydraulic oil that operates cylinder 37 based on the command pilot pressure generated by electromagnetic proportional control valve 59.

Tank 63 is a tank for storing oil used by main pump 56A and pilot pump 56B.

(3) Functional Configuration

Figure 12:
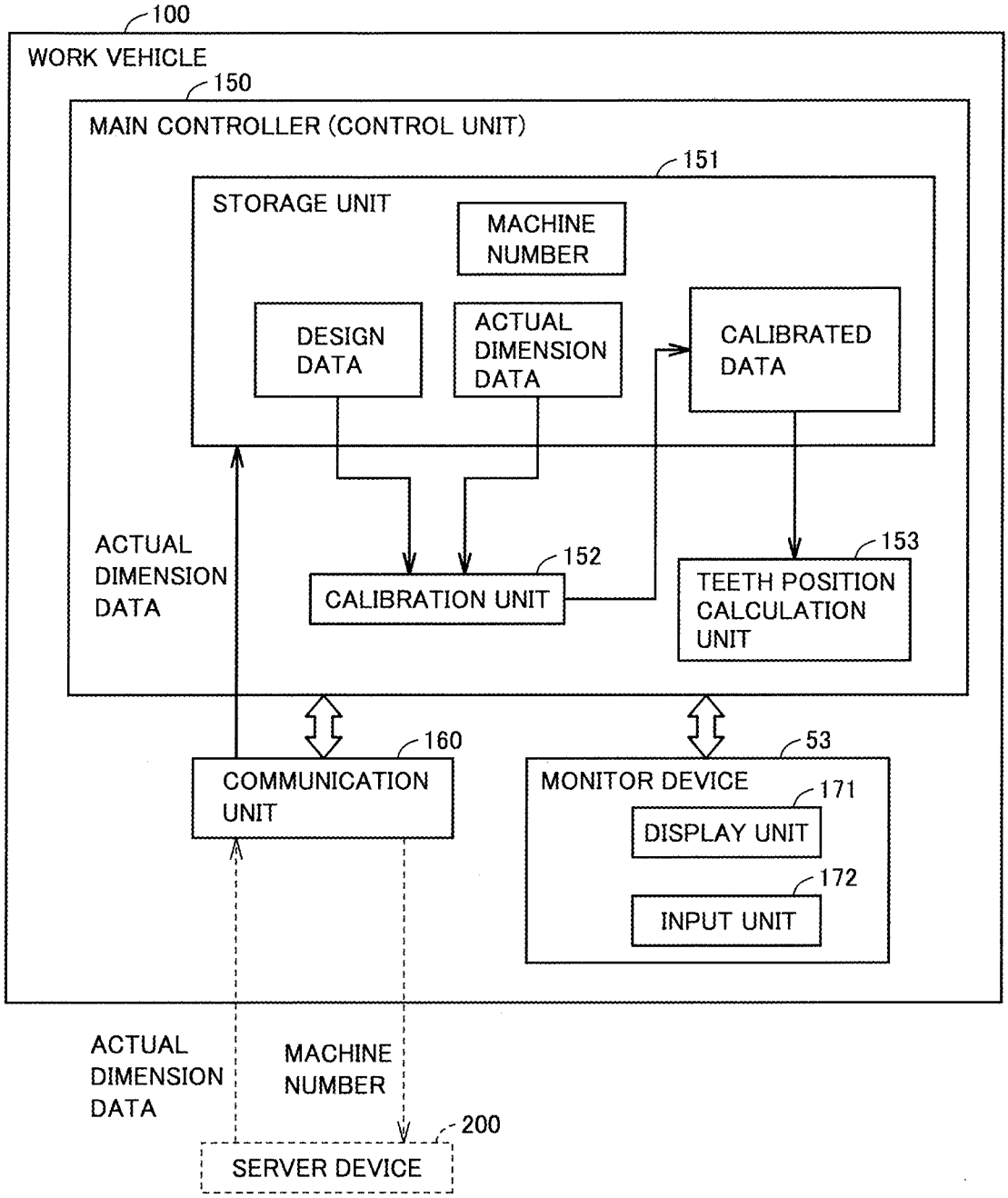
FIG. 12 is a functional block diagram representing a functional configuration of a work vehicle.

FIG. 12 is a functional block diagram representing a functional configuration of work vehicle 100.

As shown in FIG. 12, work vehicle 100 includes main controller 150, a communication unit 160, and monitor device 53. Main controller 150 has a storage unit 151, a calibration unit 152, and a teeth position calculation unit 153. Monitor device 53 has a display unit 171 and an input unit 172.

Communication unit 160 is an interface for communicating with server device 200. Communication unit 160 obtains the actual dimension data described above from server device 200, and transmits the actual dimension data to main controller 150. The actual dimension data is stored in storage unit 151.

Storage unit 151 previously stores therein a plurality of pieces of design data such as a designed dimension and a designed angle. For the present example, the 19 pieces of design data shown in FIG. 9 are previously stored in storage unit 151 of main controller 150.

Calibration unit 152 uses the actual dimension data for distances L01, L11, L12, L13, L21, L22, L23, L24, L31 and uses the design data per se for the other values (distances L02, L32, L33, L34, Lbms, Lams, Lbks, and angles Phibm, Phiam, Phibk) to calibrate these 19 values, as has been described with reference to FIG. 10. Calibration unit 152 stores the thus calibrated data in storage unit 151.

Teeth position calculation unit 153 uses the calibrated data to calculate the position of teeth 139.

Display unit 171 displays a variety of screens. For example, display unit 171 displays a variety of guidance for the calibration process.

Input unit 172 receives a variety of input operations. In one aspect, input unit 172 receives an instruction to perform the calibration process.

When input unit 172 receives an instruction to perform the calibration process, main controller 150 performs control to transmit the machine number of work vehicle 100 to server device 200 via communication unit 160. The machine number is previously stored in storage unit 151.

The instruction to perform the calibration process is an example of a "predetermined operation" in the present invention.

<Flow of Process>

Figure 13:
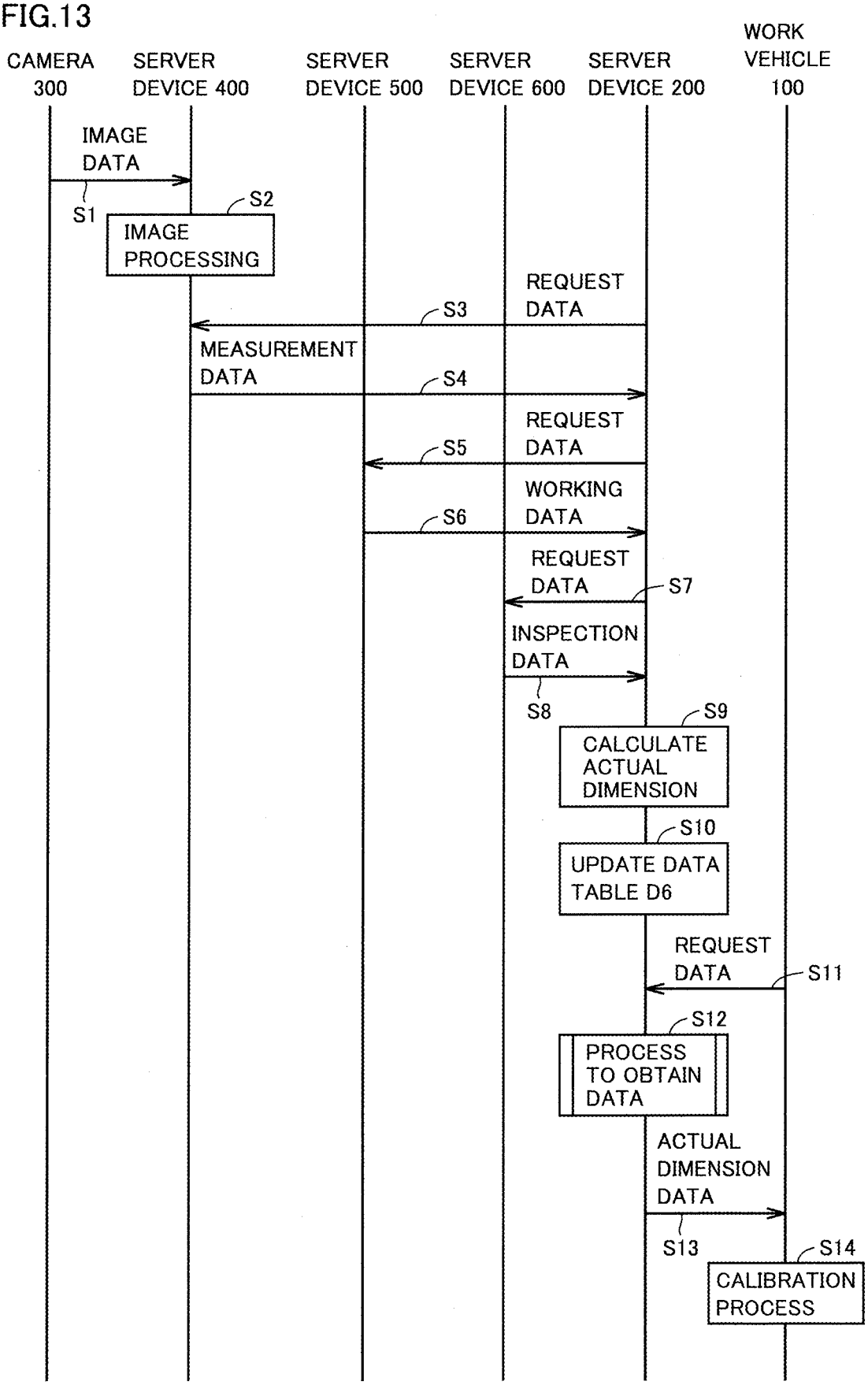
FIG. 13 is a sequence diagram for illustrating a flow of a process in the work machine system.

FIG. 13 is a sequence diagram for illustrating a flow of a process in work machine system 1.

As shown in FIG. 13, in sequence S1, camera 300 images work vehicle 100 to obtain image data, and sends the image data to server device 400. In sequence S2, server device 400 subjects the received image data to predetermined image-processing to calculate three-dimensional coordinate data (measurement data) between reflectors. Server device 400 calculates three-dimensional coordinate data of the reflectors for each of a plurality of work vehicles 100.

In sequence S3, server device 200 requests server device 400 to transmit measurement data. In sequence S4, server device 400 transmits the measurement data to server device 200.

In sequence S5, server device 200 requests server device 500 to transmit measurement data. In sequence S6, server device 500 transmits working data to server device 200.

In sequence S7, server device 200 requests server device 600 to transmit measurement data. In sequence S8, server device 600 transmits inspection data to server device 200.

In sequence S9, server device 200 calculates actual dimensions of distances L01, L11, L12, L13, L21, L22, L23, L24, L31 based on the received measurement data, working data, and inspection data (see FIGS. 4 and 9). When the inspection data obtained from server device 600 is not used, server device 200 calculates the actual dimensions of distances L01, L11, L12, L13, L21, L22, L22, L23, L24, L31 based on the received measurement data and working data.

In sequence S10, server device 200 uses the calculated actual dimensions to update data table D6 (FIG. 6). In sequence S11, work vehicle 100 requests server device 200 to transmit the vehicle's actual dimension data used for calibration. In the present example, work vehicle 100 transmits a request signal including the machine number of work vehicle 100 to server device 200.

In sequence S12, control unit 210 of server device 200 performs a process of obtaining data for the requester work vehicle from storage unit 220. In sequence S13, server device 200 transmits the requester's actual dimension data to the requester or work vehicle 100. In sequence S14, work vehicle 100 performs a calibration process using the obtained actual dimension data.

Figure 14:
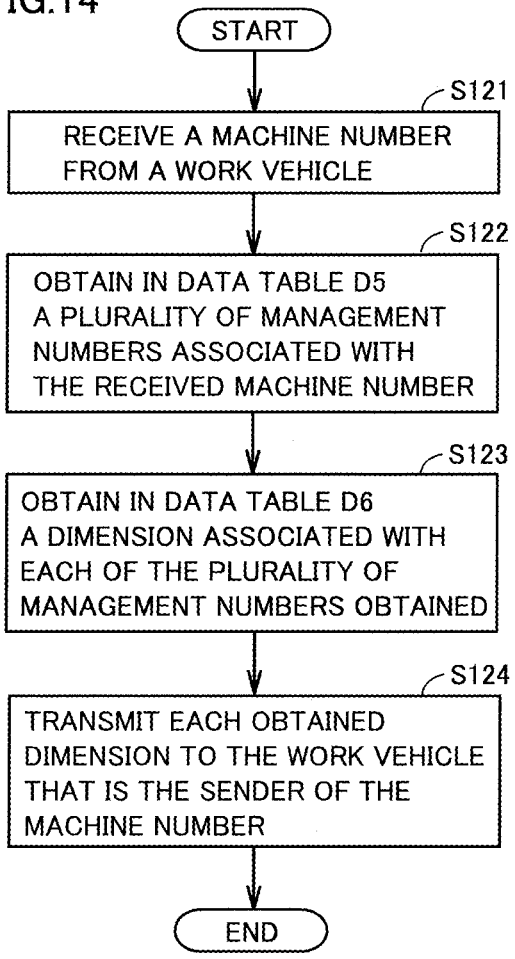
FIG. 14 is a flowchart for specifically illustrating the process of sequence S12 in FIG. 13.

FIG. 14 is a flowchart for specifically illustrating the process of sequence S12 in FIG. 13.

As shown in FIG. 14, in step S121, server device 200 receives a machine number from a work vehicle. For example, server device 200 receives a machine number "A102001" from work vehicle 100.

In step S122, server device 200 obtains in data table D5 stored in storage unit 220 a plurality of management numbers associated with the received machine number. For example, server device 200 obtains nine management numbers "No. 10001," "No. 20001," "No. 30001," . . . , "No. 90001."

In step S123, server device 200 obtains in data table D6 (data tables D61 to D69) stored in storage unit 220 a dimension associated with each of the plurality of management numbers obtained in step S122.

In step S124, server device 200 transmits nine dimensions obtained in step S123 to the work vehicle that is the sender of the machine number. For example, server device 200 transmits the nine dimensions to work vehicle 100 that is the sender of the management number "A102001."

<Advantage>

It can be said that server device 200 of work machine system 1 according to the present embodiment has the following configuration: Further, this configuration achieves the following effect:

(1) Work vehicle 100 transmits a machine number associated with work vehicle 100 to server device 200. Server device 200 has data obtaining unit 213 that obtains data based on the machine number and used for calculating the position of teeth 139 of bucket 130 (hereinafter also referred to as "basic data") and transmission unit 232 that transmits the obtained dimension to work vehicle 100.

According to such a configuration, when work vehicle 100 transmits the machine number of work vehicle 100 to server device 200, work vehicle 100 can obtain from server device 200 data used for calculating the position of teeth 139 of work vehicle 100 (i.e., basic data).

Therefore, according to work machine system 1, work vehicle 100 can obtain data used for calculation of the position of teeth 139 simply by transmitting the machine number. Therefore, according to work machine system 1, data used for calculating the position of teeth 139 of work vehicle 100 can be obtained quickly.

Note that after work vehicle 100 obtains the plurality of pieces of data, it performs the above-described calibration process using the obtained data.

(2) Server device 200 further includes storage unit 220 that associates first basic data and second basic data with a machine number and thus stores the first basic data and the second basic data as the above basic data. Data obtaining unit 213 obtains the first basic data and the second basic data from storage unit 220 based on the machine number.

According to such a configuration, when work vehicle 100 transmits the machine number of work vehicle 100 to server device 200 work vehicle 100 can obtain from server device 200 all at once two pieces of basic data used for calculating the position of teeth 139 of work vehicle 100.

(3) Storage unit 220 associates a first dimension obtained based on manufacturing data of a first component included in work implement 104 with the machine number and thus stores the first dimension as the first basic data, and associates a second dimension obtained based on manufacturing data of a second component included in work implement 104 with the machine number and thus stores the second dimension as the second basic data.

According to such a configuration, when work vehicle 100 transmits the machine number of work vehicle 100 to server device 200 work vehicle 100 can obtain from server device 200 all at once two dimensions used for calculating the position of teeth 139 of work vehicle 100.

(4) The basic data is a dimension obtained based on manufacturing data of a component included in work implement 104. According to such a configuration, the dimension obtained based on the manufacturing data of the component can be used for the calibration process in work vehicle 100.

(5) The manufacturing data is, for example, machining data obtained when machining boom 110. According to such a configuration, the machining data obtained when machining boom 110 can be used for the calibration process in work vehicle 100.

(6) The manufacturing data is, for example, machining data obtained when machining dipper stick 120. According to such a configuration, the machining data obtained when machining dipper stick 120 can be used for the calibration process in work vehicle 100.

(7) The basic data is a dimension between teeth 139 of work vehicle 100 and bucket pin 142 (see FIG. 4). According to such a configuration, the dimension between teeth 139 of work vehicle 100 and bucket pin 142 (measurement data) can be used for the calibration process in work vehicle 100.

(8) The basic data is a dimension representing a dimension between receiving antenna 109 for a global positioning satellite system and foot pin 141. According to such a configuration, the dimension between receiving antenna 109 and foot pin 141 (measurement data) can be used for the calibration process in work vehicle 100.

(9) Work vehicle 100 previously stores the machine number of work vehicle 100, and when work vehicle 100 receives an instruction to perform the calibration process work vehicle 100 transmits the machine number to server device 200. According to such a configuration, the operator of work vehicle 100 can transmit the machine number of work vehicle 100 to server device 200 simply by instructing work vehicle 100 to perform the calibration process. <Modification>

(1) In the above embodiment, main controller 150 uses a dimension obtained based on manufacturing data of a component included in work implement 104 to calibrate design data used for calculating the position of teeth 139 and uses the calibrated design data to calculate the position of teeth 139. However, it is also possible to quickly obtain design data used for calculation of the position of teeth 139 without performing such calibration. Hereinafter, such a configuration will be described.

In the present modification, main controller 150 obtains design data based on a dimension obtained from manufacturing data, and used for calculating the position of teeth 139, and uses the design data to calculate the position of teeth 139. Further, main controller 150 obtains design data based on a dimension obtained from image data, and used for calculating the position of teeth 139, and uses the design data to calculate the position of teeth 139.

When this is described with reference to FIG. 9 showing data D9, main controller 150 uses working data-based dimensions as design data for dimensions of Nos. 3 to 9 and uses image data-based dimensions as design data for dimensions of Nos. 1 and 10. For example, for the dimension of No. 3, as design data, instead of "*. 12," "*. 35," which is a working data-based dimension, is used.

Main controller 150 calculates the position of teeth 139 using design data of 19 values (dimensional and angular values) including these working data- and image data-based actual dimensions. More specifically, main controller 150 for example substitutes ten values in the FIG. 10 data D10 indicated at the "design data" column and nine values in the data indicated at the "dimension obtained from server device 200" column, without calibration, into variables in a program for calculating the position of teeth 139. Thus, main controller 150 calculates the position of teeth 139.

Such a configuration eliminates the necessity of main controller 150 performing the calibration process. The present modification allows design data used for calculating the position of teeth 139 to be obtained faster than a configuration with the calibration process performed.

Further, manufacturing data-based dimension and image data-based dimension are used, and it is unnecessary to use a measuring instrument or the like on the production line for work vehicle 100. Therefore, design data used for calculating the position of teeth 139 can be obtained rapidly, even when compared with such a case that employs a measuring instrument.

(2) In the above description, a machine number is used as information for identifying each work vehicle 100 from one another by way of example. However, the information is not limited to a machine number insofar as the information is a unique identification number. The information may be any information that allows that unique identification number to uniquely identify the machine number.

(3) In sequence S11 of FIG. 13, a configuration has been described by way of example in which work vehicle 100 transmits a request signal including a machine number. However, the sender of the machine number may not be the work vehicle and instead be a tablet terminal.

In such a configuration, work machine system 1 may be configured such that a dimension obtained in server device 200 is transmitted to a work vehicle having the machine number, rather than the sender of the machine number.

Alternatively, a dimension obtained by server device 200 may be transmitted to a tablet terminal that is the sender of the machine number. In that case, the operator will refer to actual dimension data displayed on the tablet terminal and manually store the data in storage unit 151 of main controller 150 via monitor device 53.

Thus, a device that is the sender of a machine number may be identical to or different from a device that receives dimension data.

(4) While in the above description a configuration in which server device 200 stores data tables D5 and D6 is described as an example, this is not exclusive.

Instead of data tables D5 and D6, server device 200 may store a data table in which a dimension (a numerical value) indicated in data table D6 is indicated in data table D5 at a management number field. In that case, server device 200 can transmit nine dimensions to work vehicle 100 simply by referring to a single data table.

It should be understood that the embodiments disclosed herein are illustrative and not limited to the above disclosure. The scope of the present invention is defined by the terms of the claims, and is intended to include any modifications within the meaning and scope equivalent to the terms of the claims.

REFERENCE SIGNS LIST

1 work machine system, 37 cylinder, 51 operation device, 53 monitor device, 54 engine controller, 55 engine, 56A main pump, 56B pilot pump, 57 swash plate drive device, 58 pilot oil path, 59 electromagnetic proportional control valve, 60 mains valve, 60A spool, 60B pilot chamber, 62 pressure sensor, 63 tank, 64 hydraulic oil path, 100, 100A, 100B work vehicle, 101 travel unit, 103 revolving unit, 104 work implement, 107 handrail, 108 operator's cab, 109 receiving antenna, 110 boom, 111 boom cylinder, 120 dipper stick, 121 dipper stick cylinder, 130 bucket, 131 bucket cylinder, 136, 137 link mechanism, 139 teeth, 141 foot pin, 142 bucket pin, 150 main controller, 151, 220 storage unit, 152 calibration unit, 153 teeth position calculation unit, 160, 230 communication unit, 171 display unit, 172 input unit, 200, 400, 500, 600 server device, 201 processor, 202 memory, 203 communication interface, 204 console key, 205 monitor, 210, 310 control unit, 211 measurement data management unit, 212 manufacturing data management unit, 213 data obtaining unit, 231 reception unit, 232, transmission unit, 299 memory card, 300 camera, 511 control lever, 512 operation detector, 700 network, 800 transceiver, 900 casting, 2111, 2121 actual dimension calculation unit, C11, C12, C21, C22 hole, Q1, Q2, Q3 center position.

The invention claimed is:

1. A work machine system comprising:

a work machine having a work implement including a bucket; and a server that communicates with the work machine, wherein the work machine transmits identification information associated with the work machine to the server, wherein the server including at least one processor and a memory, the at least one processor executes a program stored in the memory, the program, when executed by the at least one processor, performs a method comprising:

obtaining, based on the transmitted identification information, basic data used for calculating a position of teeth of the bucket, the basic data is a dimension obtained based on manufacturing data of a component included in the work implement, and transmitting the obtained basic data to the work machine, and wherein the work machine, performs a method comprising:

receiving the basic data from the server, calculating positional information of the teeth of the bucket based on the received basic data, and controlling operation of the work implement to prevent damage a design surface when the calculated positional information of the teeth are determined to reach the design surface, wherein when a controller determines that the teeth has reached the design surface, the controller automatically stops the work implement or moves the teeth of the bucket along the design surface via an assistive function.

2. The work machine system according to claim 1, wherein the server further includes a storage unit that associates first basic data and second basic data with the identification information, and stores the first basic data and the second basic data as the basic data, and wherein the program, when executed by the at least one processor, performs the method further comprising:

obtaining the first basic data and the second basic data from the storage unit based on the transmitted identification information.

3. The work machine system according to claim 2, wherein the storage unit associates a first dimension obtained based on manufacturing data of a first component included in the work implement with the identification information, stores the first dimension as the first basic data, associates a second dimension obtained based on manufacturing data of a second component included in the work implement with the identification information, and store the second dimension as the second basic data.

4. The work machine system according to claim 3, wherein the work implement further includes a boom as the first component, and the manufacturing data is machining data obtained when machining the boom.

5. The work machine system according to claim 3, wherein the work implement further includes a dipper stick as the first component, and the manufacturing data is machining data obtained when machining the dipper stick.

6. The work machine system according to claim 1, wherein the work implement further includes a dipper stick and a bucket pin that connects the bucket to the dipper stick, and the basic data is a dimension between the teeth of the work implement and the bucket pin.

7. The work machine system according to claim 1, wherein the work machine further includes a receiving antenna for a global positioning satellite system, the work implement further includes a boom, and a foot pin attaching the boom to a vehicular body, and the basic data is a dimension representing a dimension between the receiving antenna and the foot pin.

8. The work machine system according to claim 1, wherein the work machine previously stores the identification information, and when the work machine receives a predetermined operation, the work machine transmits the identification information to the server.

9. The work machine system according to claim 1, wherein the identification information is a machine number of the work machine.

10. A method for controlling a server capable of communicating with a work machine having a work implement including a bucket, comprising:

receiving, at the transmitting, to a server from the work machine, identification information associated with the work machine; obtaining, by machine, wherein the server, based on the received transmitted identification information, obtains basic data used for calculating a position of teeth of the bucket, and the basic data is a dimension obtained based on manufacturing data of a component included in the work implement;

transmitting receiving, at the work machine from the server, the obtained basic data to the work machine data;

calculating positional information of the teeth of the bucket based on the received basic data; and controlling operation of the work implement to prevent damage a design surface when the calculated positional information of the teeth are determined to reach the design surface, wherein when a controller determines that the teeth has reached the design surface, the controller automatically stops the work implement or moves the teeth of the bucket along the design surface via an assistive function.

* * * * *